US006634726B1

(12) United States Patent
Slivon

(10) Patent No.: US 6,634,726 B1
(45) Date of Patent: Oct. 21, 2003

(54) MULTIPLE DRAWER CABINET ALLOWING ONE DRAWER OPENED AT A TIME

(75) Inventor: George R. Slivon, Kenosha, WI (US)

(73) Assignee: Snap-on Technologies, Inc., Lincolnshire, IL (US)

( * ) Notice: Subject to any disclaimer, the term of this patent is extended or adjusted under 35 U.S.C. 154(b) by 0 days.

(21) Appl. No.: 09/867,823

(22) Filed: May 30, 2001

(51) Int. Cl.[7] ..... E05C 7/06
(52) U.S. Cl. ..... 312/221; 312/217
(58) Field of Search ..... 312/215, 216, 312/217, 218, 219, 221, 222

(56) References Cited

U.S. PATENT DOCUMENTS

| | | | | |
|---|---|---|---|---|
| 26,902 A | | 1/1860 | Gray | |
| 1,307,581 A | | 6/1919 | Gale | |
| 2,886,392 A | | 5/1959 | Stegmaier | |
| 3,404,929 A | | 10/1968 | Wright et al. | |
| 3,589,783 A | | 6/1971 | Anderson | |
| 3,874,755 A | | 4/1975 | Hegg et al. | |
| 3,883,199 A | | 5/1975 | Cawley, Jr. | |
| 3,888,558 A | | 6/1975 | Himsl | |
| 4,298,236 A | | 11/1981 | Laroche | |
| 4,425,013 A | | 1/1984 | Killen | |
| 4,609,233 A | | 9/1986 | Walla | |
| 4,637,667 A | | 1/1987 | Reid et al. | |
| 4,865,404 A | * | 9/1989 | Harper | 312/221 |
| 4,889,396 A | | 12/1989 | Mitchell et al. | |
| 4,925,257 A | | 5/1990 | Frederiksen | |
| 4,955,672 A | | 9/1990 | Pham | |
| 4,966,422 A | | 10/1990 | Albright et al. | |
| 5,040,858 A | | 8/1991 | Kruse et al. | |
| 5,056,877 A | * | 10/1991 | Westwinkel | 312/221 |
| 5,172,967 A | * | 12/1992 | Pipe | 312/217 |
| 5,241,133 A | | 8/1993 | Mullen, III et al. | 174/52.4 |
| 5,352,030 A | * | 10/1994 | Derle et al. | 312/221 |
| 5,387,032 A | | 2/1995 | Reisbeck | |

(List continued on next page.)

FOREIGN PATENT DOCUMENTS

| | | | | |
|---|---|---|---|---|
| DE | 2916245 | | 11/1980 | |
| DE | 3633256 | * | 3/1988 | 312/221 |
| DE | 3818610 | * | 8/1989 | 312/221 |
| DE | 4040724 | * | 5/1991 | 312/221 |
| EP | 639687 | | 2/1995 | |
| GB | 2095322 | * | 9/1982 | 312/221 |
| GB | 2096229 | | 10/1982 | |
| GB | 2170993 | * | 8/1986 | 312/221 |
| GB | 2297800 | | 8/1996 | |

OTHER PUBLICATIONS

Accuride® Model 3600 specification sheets (2).
U.S. patent application Ser. No. 09/867,823, inventor: Silvon, filed: May 30, 2001.

*Primary Examiner*—Lanna Mai
*Assistant Examiner*—Hanh V. Tran
(74) *Attorney, Agent, or Firm*—Seyfarth Shaw

(57) ABSTRACT

A multi-drawer device includes a first drawer and a second drawer, each carried by a housing, and movable between a closed position disposed within a housing and an open position extending from the housing. A first slide assembly couples the first drawer to the housing and a second slide assembly couples the second drawer to the housing. A ramp and follower are each associated with the first drawer and the follower is adapted to contact and slide along the ramp. A first blocking device is associated with the second slide assembly and coupled to one of the ramp and the follower. The ramp, the follower and the first blocking device all cooperate such that as the first drawer moves from the closed position toward the open position, the follower contacts and slides along the ramp, for moving the first blocking device into a locked position that interferes with the second slide assembly to prevent the second drawer from moving to the open position.

18 Claims, 6 Drawing Sheets

U.S. PATENT DOCUMENTS 5,394,011 A 2/1995 Yamamoto et al. ..... 257/693
5,548,999 A 8/1996 Kakizaki et al. ..... 73/493
5,599,077 A 2/1997 Law et al.
5,599,078 A 2/1997 Dechene et al.
5,605,388 A 2/1997 Laakso
5,634,701 A 6/1997 Hendrich et al.
5,671,985 A 9/1997 Grieser et al.
5,829,859 A * 11/1998 Cram ..... 312/221
5,855,423 A * 1/1999 Cram ..... 312/221
5,997,114 A 12/1999 Bischoff
6,238,024 B1 * 5/2001 Sawatzky ..... 312/221
6,254,205 B1 * 7/2001 Wright et al. ..... 312/217
6,296,332 B1 * 10/2001 Lammens ..... 312/217

* cited by examiner

MULTIPLE DRAWER CABINET ALLOWING ONE DRAWER OPENED AT A TIME

BACKGROUND

The following disclosure relates to devices having multiple drawers, and has particular application to apparatus and methods for preventing more than one drawer from being opened in a multi-drawer device, such as a cabinet or the like.

Various types of multi-drawer devices are provided with mechanisms to prevent more than one drawer from opening at a time. However, many prior designs utilize highly complex components that take up excessive amounts of space.

In some forms, these complex mechanisms are located in the rear of the multi-drawer device between the drawers and the back wall of the housing. This type of design often causes the multi-drawer device to be longer than necessary, or the drawers to be shorter than would otherwise be allowable, because of the space taken up between the drawers and the back end of the multi-drawer device. Examples of such systems are shown in U.S. Pat. Nos. 3,874,755 and 5,605,388.

Other forms of locking mechanisms include multiple complex parts that take up excessive amounts of space between the sides of a drawer and one or more side walls of a multi-drawer device. Such designs can cause these multi-drawer devices to be wider than otherwise would be necessary, or conversely require that the drawers be narrower than would otherwise be allowed in the same size multi-drawer device. Examples of such side mounted locking devices include U.S. Pat. Nos. 3,404,929; 3,883,199; 3,888,558; 4,609,233; 4,637,667; 4,889,396; 4,925,257; 4,966,422; 5,040,858; 5,387,032; 5,599,077; 5,599,078; 5,634,701; and 5,671,985.

Such side mounted devices and rear mounted devices each suffer from having an excessive number of relatively complex pieces that interact with one another and often take up a lot of space in between the drawer and the housing of the multi-drawer device. While some of these designs may be perfectly adequate for some uses, they tend to require a multi-drawer device to be larger than would be otherwise be necessary or require that smaller drawers be utilized for the same size multi-drawer device.

SUMMARY

The disclosed apparatus and methods avoid some of the disadvantages of prior devices and methods while affording additional structural and operating advantages.

One form of the disclosed multi-drawer device comprises a plurality of drawers supported in a housing and coupled to the housing with slide assemblies. A blocking device is included that is responsive to the movement of a first drawer toward a fully opened position to interfere with the slide assembly of a second drawer thereby preventing the second drawer from fully opening.

One form of the disclosed multi-drawer device comprises first and second drawers carried by a housing and moveable between a closed position disposed within the housing and an open position extending from the housing. A first slide assembly couples the first drawer to the housing and second slide assembly couples the second drawer to the housing. A ramp is associated with the first drawer and a follower is adapted to contact and slide along the ramp. A blocking device is couple to one of the ramp and the follower and is associated with the second slide assembly. The ramp, follower, and first blocking device all cooperate such that as a first drawer moves from the closed position toward the open position, the follower contacts and slides along the ramp, for moving the first blocking device into a locked position that interferes with the second slide assembly to prevent the second drawer from moving to the open position.

The disclosed multi-drawer device and locking mechanism comprises certain novel features and a combination of parts hereinafter fully described and illustrated in the accompanying drawings, it being understood that various changes in the details may be made without departing from the spirit, or sacrificing any of the advantageous of the present disclosed multi-drawer device and locking mechanism.

BRIEF DESCRIPTION OF THE DRAWINGS

For the purpose of facilitating an understanding of the disclosed apparatus and method, there are illustrated in the accompanying drawings preferred embodiments thereof, from an inspection of which, when considered in connection with the following description, the disclosed apparatus and method, its construction and operation, and many of its advantages should be readily understood and appreciates.

DETAILED DESCRIPTION

Figure 1:
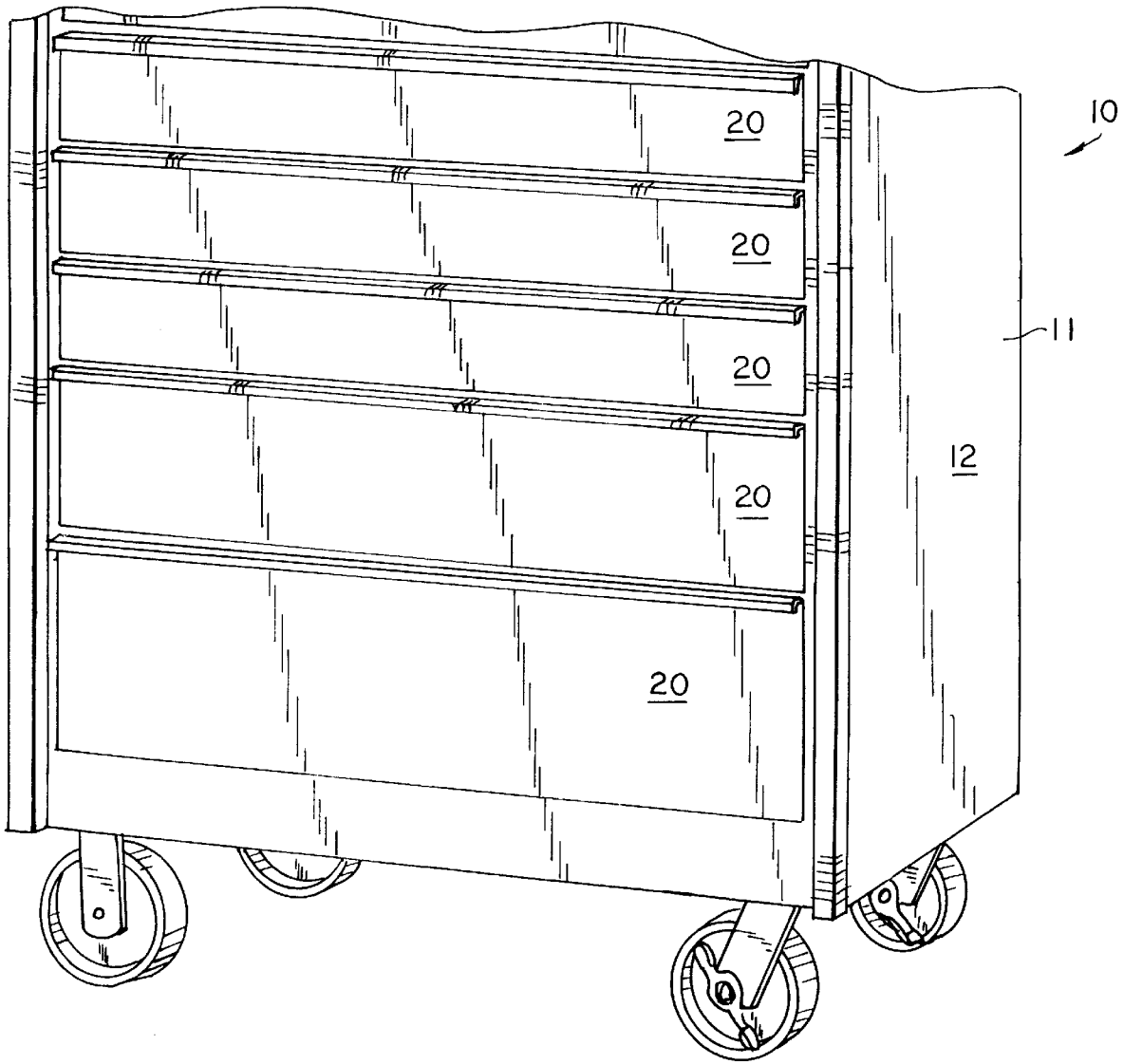
FIG. 1 is a fragmentary perspective view of a multi-drawer device, the drawers being in a closed position.

Referring to FIG. 1, there is illustrated a multi-drawer device 10 having a housing 11 carrying a plurality of drawers 20. Drawers 20 can have many features in common with other drawer designs. For example, referring also to FIG. 2, drawer 20 includes side walls 22, 23. A slide assembly 30 can be provided to couple drawer 20 to multi-drawer device 10. In the depicted form, slide assembly 30 is a three-member telescoping slide mechanism comprising a first member 32 coupled to drawer 20, for example to one of end walls 22, 23; a second member 34 coupled to housing 11, for example to one of side walls 12, 13; and intermediate member 36 coupling first member 32 and second member 34 together. In one form, intermediate member 36 includes an indentation, such as channel 38, formed therein that faces away from the drawer side wall 22 or 23 that channel 38 is closest to. In other words, channel 38 faces towards the housing side wall 12, 13 that channel 38 is closest to.

A drawer locking assembly 40 is provided to minimize the possibility of more than one drawer being opened at the same time, thereby reducing the probability of multi-drawer device 10 tipping over. Drawer locking assembly 40 can comprise a ramp 42, a follower 44 and a blocking device 46. Ramp 42 and blocking device 46 form a guide 56 therebetween that is adapted to receive follower 44 and position follower 44 for movement along ramp 42. Follower 44 can be coupled to drawer 20, such as toward the front of a side wall 22, 23. In one form, each drawer 20 has one ramp 42, one follower 44, and one blocking device 46 associated therewith. A bar 48 can couple each set of ramp 42 and blocking device 46 to one another. Bar 48 is slidably coupled to one of side walls 12, 13 of multi-drawer device 10. In one form, a plurality of elongated openings 50 are provided in bar 48. A fastener 52, having head 54, slidably couples bar 48 (through elongated opening 50) to one of housing side walls 12, 13.

Ramp 42, blocking device 46, and bar 48 all have a small profile that readily fits in between a drawer side wall 22 or 23 and a side wall 12 or 13 of multi-drawer device 10. In one form, ramp 42, blocking device 46 and bar 48 can fit between a drawer side wall 22 or 23 and intermediate member 36 of slide assembly 30. A protrusion coupled to bar 48, such as ramp 42 and/or blocking device 46, can be adapted to fit at least partially within drawer slide channel 38.

Figure 2:
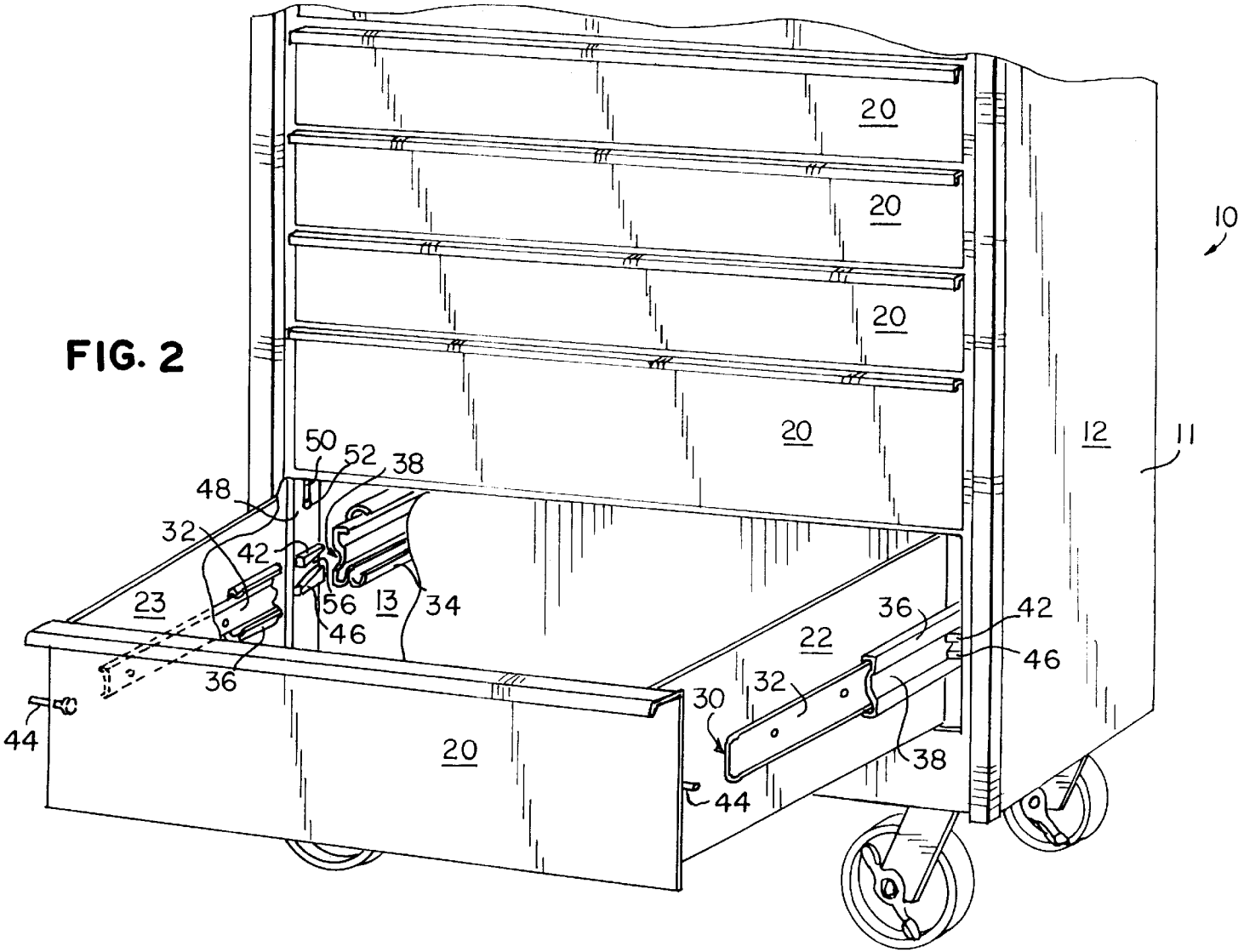
FIG. 2 is a fragmentary perspective view of the multi-drawer device of FIG. 1, with one drawer in an opened position extending from the housing.

As depicted in FIG. 2, a slide assembly 30 can be provided for each drawer side walls 22, 23. In this case, one drawer locking assembly 40 can also be provided on each side wall 12, 13 of multi-drawer device 10. Alternatively, it is possible that only one drawer locking assembly 40 would be provided, even where two slide assemblies 30 are used. However, two drawer locking assemblies 40 will keep the drawers more secure.

Figure 3:
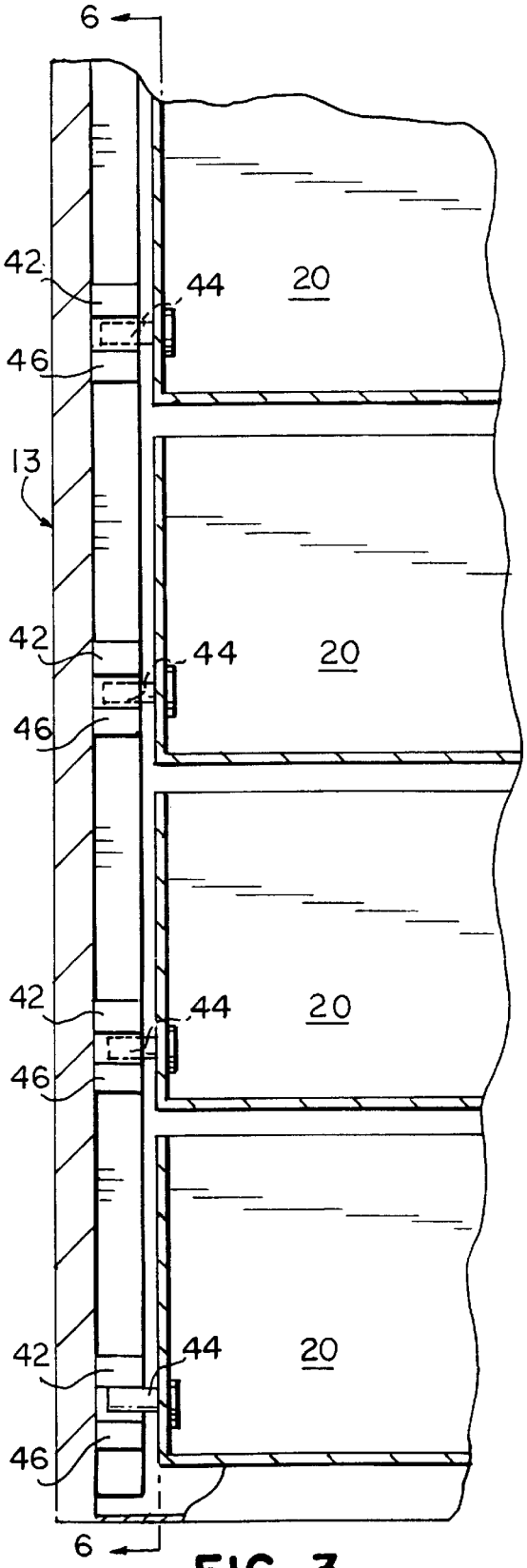
FIG. 3 is an enlarged, fragmentary view in vertical section of the multi-drawer cabinet of FIG. 2.
Figure 4:
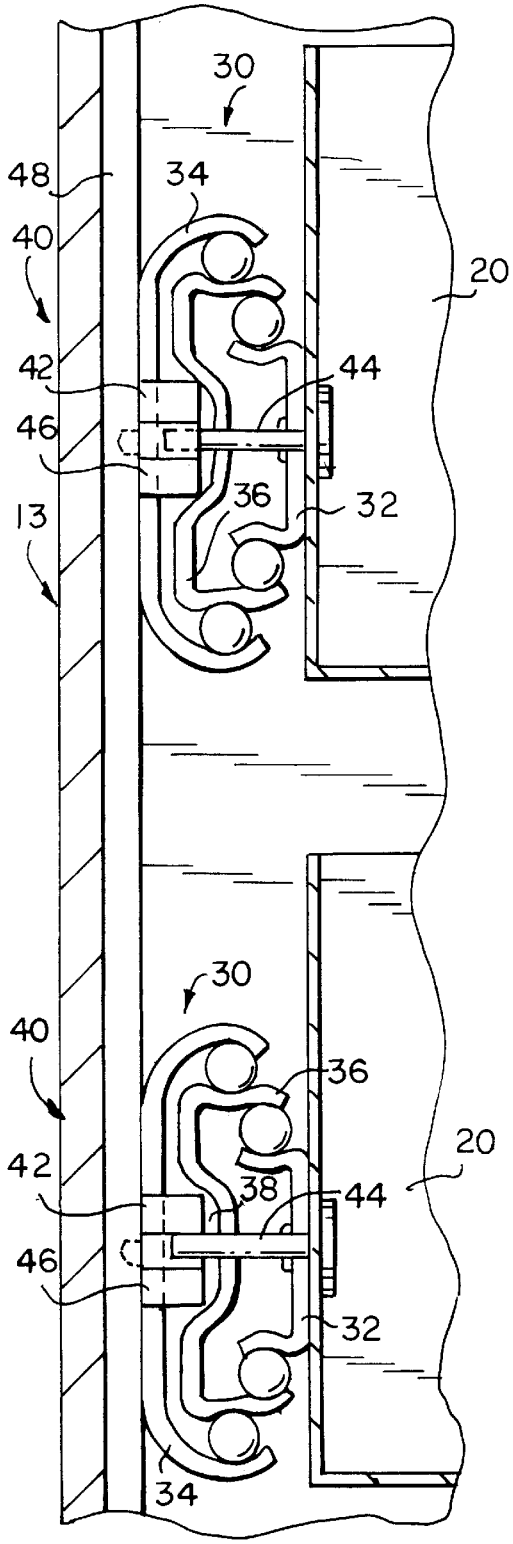
FIG. 4 is a further enlarged, fragmentary view in vertical section of the multi-drawer device of FIG. 2.
Figure 6:
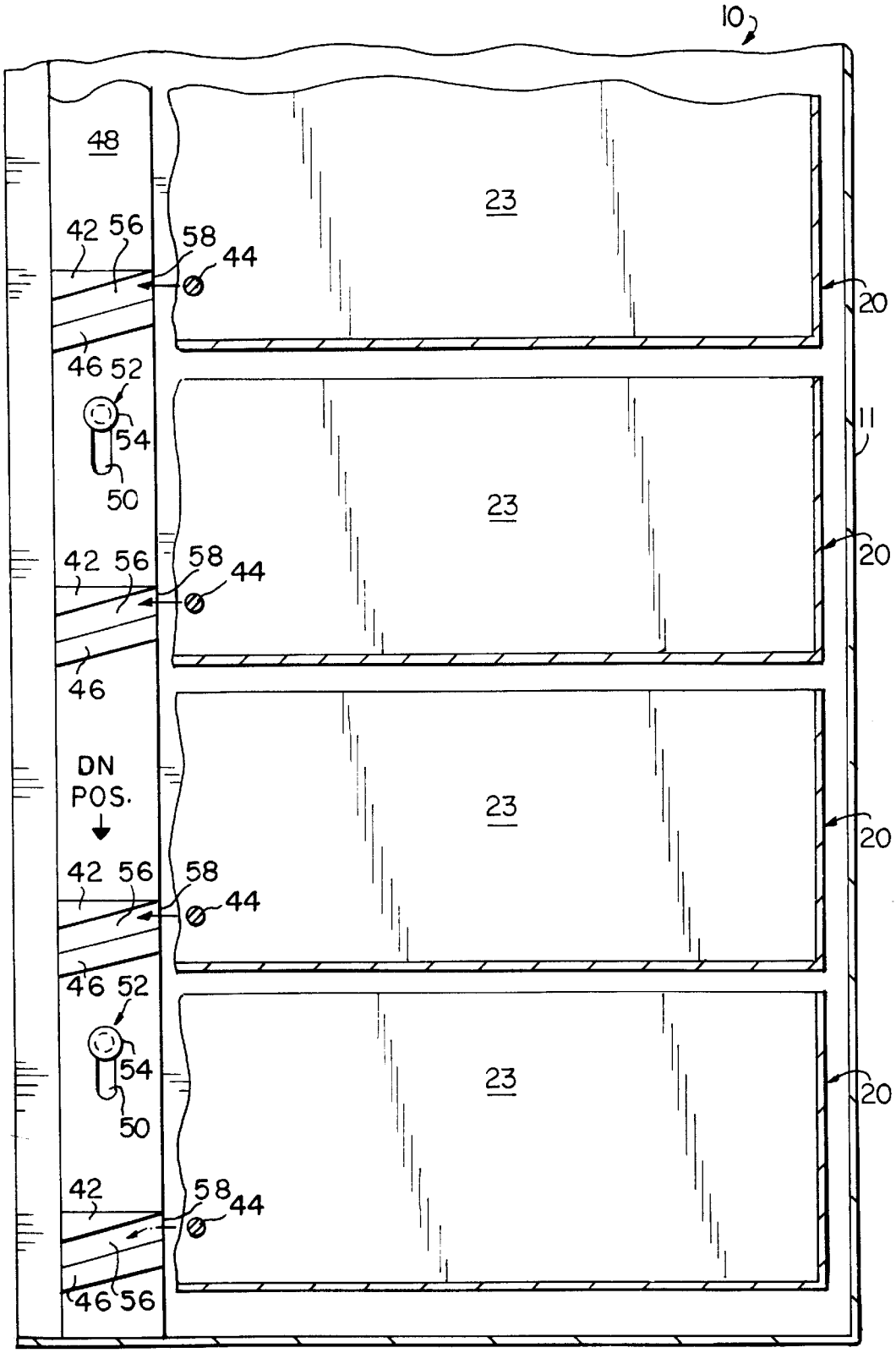
FIG. 6 is a famentary view in vertical section of the multi-drawer device of FIG. 3 taken along lines 6—6.
Figure 7:
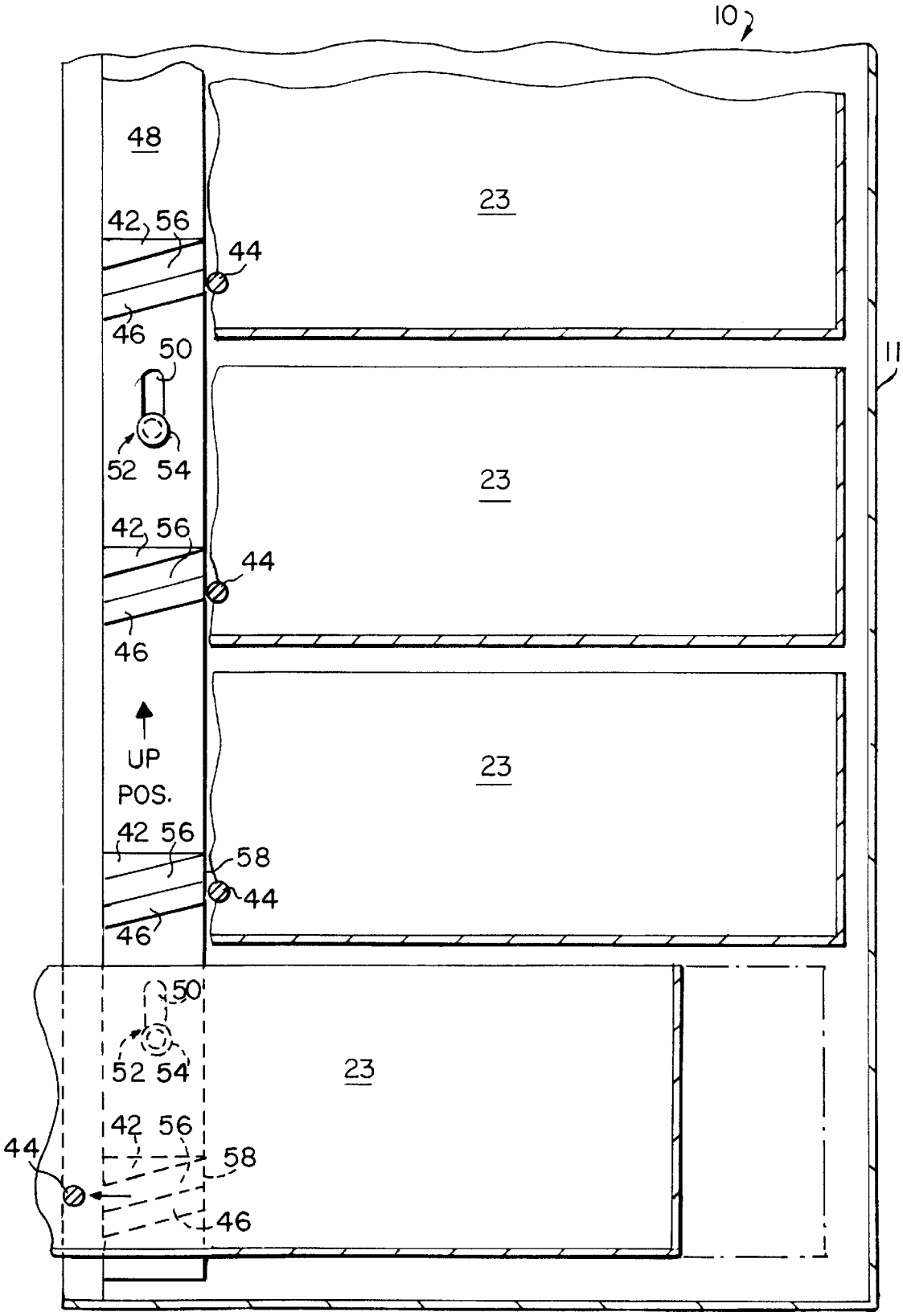
FIG. 7 is a view similar to FIG. 6 with the multi-drawer device in the position of FIG. 2.

In use, gravity or another force, such as a spring (not shown), biases bar 48, and thus ramp 42 and blocking device 46, downward (shown in FIG. 6). When all drawers 20 are in a closed position, follower 44 is aligned with the leading end 58 of guide 56 (see FIGS. 3, 4, and 6). As one of drawers 20 moves from the closed position to the open position, follower 44 enters leading edge 58 of guide 56 and contacts ramp 42. As drawer 20 is pulled further open, follower 44 moves along guide 56 and slides along ramp 42 causing ramp 42, bar 48 and locking device 46, to move opposite the initial biased position, as shown in FIG. 7.

Follower 44 causes ramp 42 and bar 48 to raise, thereby raising the blocking devices 46 associated with the still closed drawers 20, such that each blocking device 46 raises in front of a follower 44 of a closed drawer into a locked position (seen in FIG. 7), thereby preventing its associated closed drawer 20 from opening.

Figure 5:
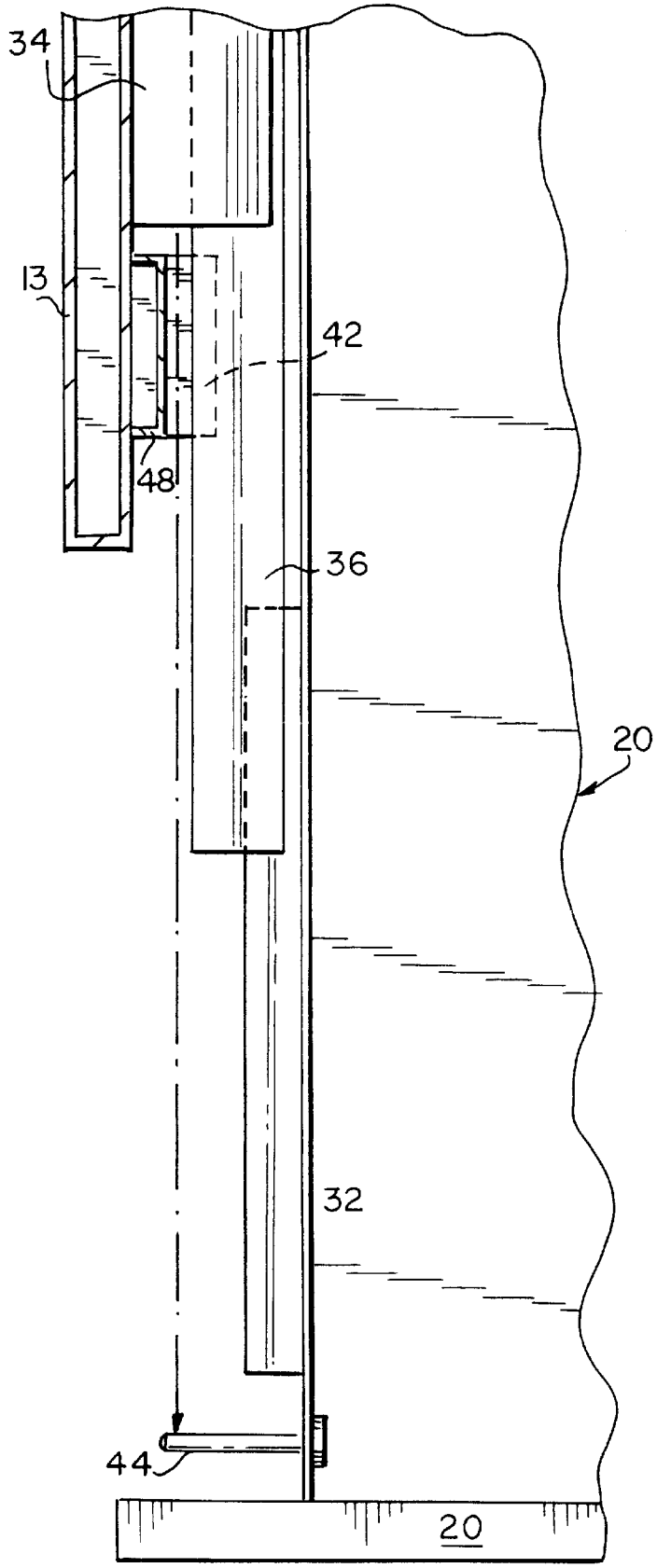
FIG. 5 is an enlarged fragmentary view in horizontal section of the multi-drawer device of FIG. 2.

As follower 44 exits guide 56, a support assembly maintains bar 48 in the locked position (shown in FIGS. 2 and 5). In one form, support assembly comprises the ramp 42, blocking device 46, and channel 38 that are associated with the open drawer. Ramp 42 and blocking device 46 protrude from bar 48 and are adapted to fit within drawer slide channel 38 before, or as, follower 44 exits guide 56 when drawer 20 is opened. As drawer 20 is opened, ramp 42 and blocking device 46 fit within drawer slide channel 38 and keep bar 48, and thus the rest of blocking device 46, in the locked position shown in FIG. 7.

Similarly, as drawer 20 is moved towards the closed position ramp 42, blocking device 46 slides out of drawer slide channel 38 and follower 44 enters guide 56. As drawer 20 is closed, bar 48 is biased downward until all the drawers are in a closed position and bar 48 and blocking device 46 are in an unlocked position, as shown in FIG. 6.

While both ramp 42 and blocking device 46 have been shown as part as the support assembly, a separate protrusion (not shown) of bar 48 could be provided to fit within and be supported by drawer slide channel 38. Alternatively, one of ramp 42 and blocking device 46 could comprise the support assembly and be retained within channel 38 while the other of ramp 42 and blocking device 46 remains outside channel 38.

One of ordinary skill in the art will recognize that a spring or other device could be used to bias bar 48 upwards and the depicted configuration of ramp 42 and blocking device 46 could be altered so that follower 44 would contact ramp 42 and cause ramp 42, bar 48 and blocking device 46 to move downward.

Additionally, another form of multi-drawer device can be used to prevent a selected second drawer from opening after a first drawer 20 is opened. In this form, a blocking device might not be associated with each of drawers, thereby allowing selected drawers to be opened even after a first drawer has been opened. A ramp, a follower, and a supporting device might not be provided for all drawers so that the opening of selected drawers would not cause any others to lock. This alternative form is especially useful for multi-drawer devices having different-sized drawer or drawers designed to carry different weights.

From the foregoing, it can be seen that there has been provided are improved multi-drawer device having a drawer locking assembly that is configured to prevent more than one drawer from being opened at the same time.

I claim:

1. A multi-drawer device comprising:

a housing;

a first drawer and a second drawer, each carried by the housing and movable between a closed position disposed within the housing and an open position extending from the housing;

a first slide assembly coupling the first drawer to the housing and a second slide assembly coupling the second drawer to the housing;

a ramp associated with the first drawer;

a follower adapted to contact and slide along the ramp;

a first blocking device coupled to one of the ramp and the follower and associated with the second slide assembly; and a support assembly adapted to retain the first blocking device;

wherein the ramp, the follower, the support assembly and the first blocking device all cooperate such that as the first drawer moves from the closed position toward the open position, the follower contacts and slides along the ramp, for moving the first blocking device into a locked position that interferes with the second slide assembly to prevent the second drawer from moving to the open position and the support assembly contacts and returns one of the ramp and the follower, thereby retaining the first blocking device in the locked position.

2. The multi-drawer device of claim 1, wherein the support assembly is adapted to retain one of the ramp and the follower when the first drawer is in the open position.

3. The multi-drawer device of claim 1, wherein the first slide assembly includes at least a portion of the support assembly.

4. The multi-drawer device of claim 3, wherein the first slide assembly includes a channel and the support assembly includes the channel.

5. The multi-drawer device of claim 4, further comprising a protrusion associated with the first drawer and coupled to the first blocking device, the protrusion adapted to be received by the channel.

6. The multi-drawer device of claim 5, further comprising a second blocking device that is associated with first drawer and wherein the protrusion includes at least one of the ramp and the second blocking device.

7. The multi-drawer device of claim 6, wherein the second blocking device and the first ramp are located adjacent to one another and form a guide therebetween, the guide adapted to position the follower for movement along the ramp.

8. The multi-drawer device of claim 6, wherein as any drawer moves from the closed position to the open position, the first blocking device and second blocking device move in conjunction with each other.

9. The multi-drawer device of claim 6, wherein the protrusion includes at least the ramp and the second blocking device.

10. The multi-drawer device of claim 4, wherein the first blocking device and the ramp are coupled together and to a wall of the housing, the first blocking device and the ramp being movable along a path parallel to the housing wall.

11. The multi-drawer device of claim 5, wherein the first slide assembly includes a three-member telescoping slide mechanism including an intermediate member having the channel formed therein.

12. The multi-drawer device of claim 11, wherein the follower is coupled to the first drawer.

13. The multi-drawer device of claim 1, wherein the first slide assembly includes a channel so that as the first drawer moves from the closed position to the open position, the channel slides past an end of one of the ramp and the follower and receives said on of the ramp and the follower, thereby retaining the first blocking device in the locked position.

14. A multi-drawer device comprising:

a housing;

a first drawer and a second drawer, each carried by the housing and movable between a closed position disposed within the housing and an open position extending from the housing;

a first slide assembly having a channel and coupling the first drawer to the housing and a second slide assembly coupling the second drawer to the housing;

a ramp associated with the first drawer;

a follower adapted to contact and move along the ramp;

a blocking device coupled to one of the ramp and the follower and associated with the second drawer; and a protrusion associated with the first drawer, coupled to the blocking device and adapted to be retained by the first slide assembly;

wherein the ramp, the follower, the channel, the blocking device, the first slide assembly and the protrusion all cooperate such that as the first drawer moves from the closed position toward the open position, the follower contacts and moves along the ramp for moving the blocking device into a retained locked position caused by the channel sliding past an end of one the ramp and the follower and receiving the one of the ramp and follower that prevents the second drawer from moving to the open position and the protrusion moves in a direction having a vertical component such that the first slide retains the protrusion thereby maintaining the blocking device in the locked position.

15. The multi-drawer device of claim 14, wherein the channel is adapted to receive and retain the protrusion, and thereby maintain the blocking device in the locked position.

16. A method of preventing fully opening of more than one drawer at a time in a device having plural drawers supported in a housing on slide assemblies, the method comprising:

positioning a blocker so as to be responsive to movement of a first drawer toward a fully open position to interfere with the slide assemblies of all other drawers thereby preventing the other drawers from fully opening; and retaining the blocker with a channel disposed on the slide assembly of the first drawer in a position that prevents the other drawers from fully opening.

17. The method of claim 16, wherein positioning the blocker comprises:

providing a ramp coupled to the blocker and providing a follower coupled to the first drawer;

contacting the ramp with the follower as the first drawer is moved toward a fully open position;

moving the blocker in either a generally upward or generally downward direction as the follower travels along the ramp until the blocker is positioned to prevent the other drawers from fully opening.

18. A multi-drawer device comprising:

a housing;

a first drawer and a second drawer, each carried by the housing and movable between a closed position disposed within the housing and an open position extending from the housing;

a ramp associated with the first drawer;

a follower adapted to contact and slide along the ramp;

a first blocking device coupled to one of the ramp and the follower and associated with the second drawer; and a support assembly adapted to retain the first blocking device;

wherein the ramp, the follower, the support assembly and the first blocking device all cooperate such that as the first drawer moves from the closed position toward the open position, the follower contacts and slides along the ramp, for moving the first blocking device into a locked position that prevents the second drawer from moving to the open position and the support assembly contacts and retains one of the ramp and the follower, thereby retaining the first blocking device in the locked position.

* * * * *

UNITED STATES PATENT AND TRADEMARK OFFICE

CERTIFICATE OF CORRECTION

PATENT NO. : 6,634,726 B1
DATED : October 21, 2003
INVENTOR(S) : Slivon

It is certified that error appears in the above-identified patent and that said Letters Patent is hereby corrected as shown below:

Title page,
Item [56], References Cited, U.S. PATENT DOCUMENTS, add
-- 3,881,793 05/1975 Anderson --; and
Inventor of U.S. Patent No. 3,589,783 should be -- Studinski et al. --.

Column 4,
Line 52, "returns" should be -- retains --.

Signed and Sealed this

Ninth Day of March, 2004

JON W. DUDAS
*Acting Director of the United States Patent and Trademark Office*